US009673539B2

(12) United States Patent
Ata et al.

(10) Patent No.: US 9,673,539 B2
(45) Date of Patent: Jun. 6, 2017

(54) SPRING BIASED CONTACT PIN ASSEMBLY

(71) Applicant: Texas Instruments Incorporated, Dallas, TX (US)

(72) Inventors: Hisashi Ata, Murphy, TX (US); Kay Chan Tong, Plano, TX (US); Thiha Shwe, Murphy, TX (US); Martin Whitfield, Plano, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 14/863,198

(22) Filed: Sep. 23, 2015

(65) Prior Publication Data

US 2017/0085013 A1 Mar. 23, 2017

(51) Int. Cl.
*H01R 13/24* (2006.01)
*H01R 4/48* (2006.01)
*H01R 43/16* (2006.01)

(52) U.S. Cl.
CPC ..... *H01R 4/48* (2013.01); *H01R 43/16* (2013.01)

(58) Field of Classification Search
CPC H01R 13/2421; H01R 23/722; H01R 4/5033; H01R 4/2466; H01L 23/4006
USPC ..... 439/700, 66, 824, 428, 397, 485
See application file for complete search history.

(56) References Cited

U.S. PATENT DOCUMENTS 5,993,269 A 11/1999 Ito
7,315,176 B2 1/2008 Nelson et al.
7,816,929 B2 10/2010 Yamada
7,845,955 B2 12/2010 Nakayama et al.
8,905,795 B2 12/2014 Kim
9,385,461 B2 7/2016 Mori
9,431,742 B2 8/2016 DiFonzo
2013/0095690 A1 4/2013 Kim et al.

FOREIGN PATENT DOCUMENTS

WO 2013188300 A1 12/2013

OTHER PUBLICATIONS

Notification of Transmittal of the International Search Report and the Written Opinion of the International Searching Authority, or the Declaration, mail date:Dec. 29, 2016.

*Primary Examiner* — Phuongchi T Nguyen
(74) *Attorney, Agent, or Firm* — Tuenlap D. Chan; Charles A. Brill; Frank D. Cimino

(57) ABSTRACT

A spring biased contact pin assembly includes a barrel member having a barrel wall defining an elongate internal cavity with a lower end and an upper end. The assembly also includes a lower plunger member reciprocally mounted in the internal cavity proximate the lower end of the internal cavity. A spring member is positioned in the internal cavity between the lower plunger member and the upper end of the internal cavity. A high electrical resistance spacer member is positioned in the internal cavity in contact with the lower plunger member and the spring member. Spring force exerted through the spacer member urges the lower plunger member into electrical contact with the barrel wall. A method of transmitting electricity through an electrical contact assembly includes urging a plunger member against the wall of a barrel member in which it is reciprocally mounted with a high electrical resistance member.

7 Claims, 6 Drawing Sheets

SPRING BIASED CONTACT PIN ASSEMBLY

BACKGROUND

A spring biased contact pin assembly is a device used in electronics to establish an electrical connection between two circuits. As used herein "spring biased contact pin assembly" refers to a cylindrical barrel containing a spring-loaded pin at either end. Each pin usually has a sharp point for making secure contact with one of the two circuits that are to be electrically connected.

One commercially available spring biased contact pin assembly is sold under the trademark "Pogo," which is a U.S. federally registered trademark of Everett Charles Technologies (ECT).

SUMMARY

A spring biased contact pin assembly includes a barrel member having a barrel wall defining an elongate internal cavity with a lower end and an upper end. The assembly also includes a lower or bottom plunger member reciprocally mounted in the internal cavity proximate the lower end of the internal cavity. A spring member is positioned in the internal cavity between the lower plunger member and the upper end of the internal cavity. A high electrical resistance spacer member is positioned in the internal cavity in contact with the lower plunger member and the spring member. Spring force exerted through the spacer member urges the lower plunger member into electrical contact with the barrel wall.

A method of transmitting electricity through an electrical contact assembly includes urging, with a high electrical resistance member, a plunger member against a wall of a barrel member in which the plunger member is reciprocally mounted.

DETAILED DESCRIPTION

Figure 1:
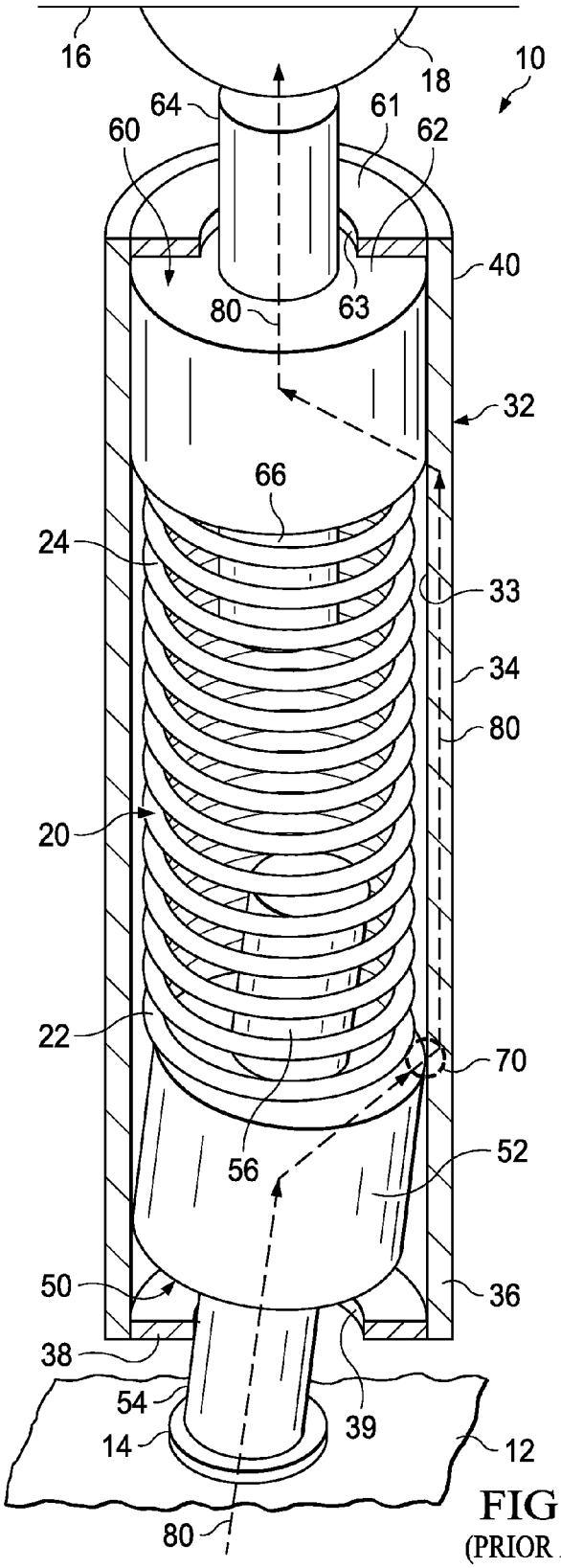
FIG. 1 (PRIOR ART)
FIG. 1 is a cut away isometric view of a prior art spring-biased contact pin assembly with good bias positioned between two electrical circuit devices.

FIG. 1 is a cut away isometric view of a prior art spring-biased contact pin assembly 10 with "good bias" positioned between two electrical circuit devices. In the illustrated embodiment, the electrical circuit devices are a load board 12 with an electrical contact 14 and a device under test (DUT) 16 with an electrical contact 18.

The spring-biased contact pin assembly 10 includes a coil spring 20 having a lower end 22 and an upper end 24. The coil spring 20 is positioned in a barrel member 32 having a tubular wall 34 extending between a lower end 36 and an upper end 40. The tubular wall defines a barrel cavity 33.

Figure 2:
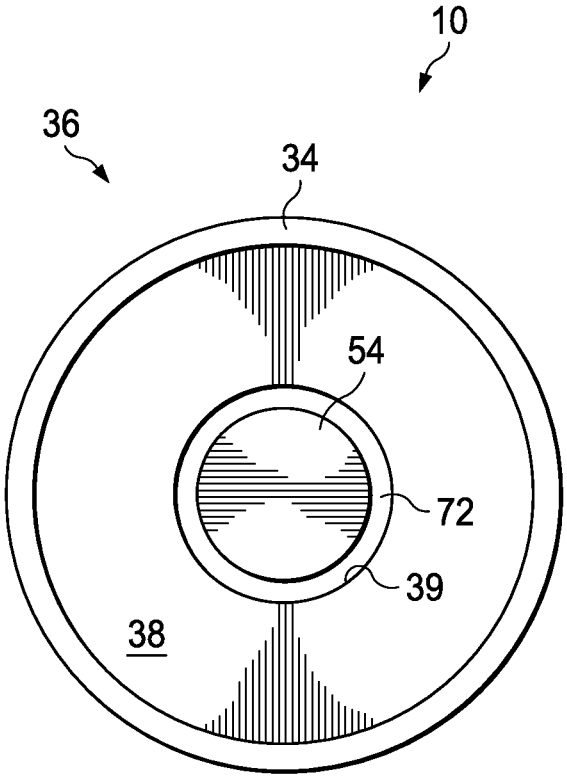
FIG. 2 (PRIOR ART)
FIG. 2 is a bottom plan view of the contact pin assembly of FIG. 1.

FIG. 2 is a bottom plan view of the contact pin assembly 10 of FIG. 1. The barrel member 32 has a lower end plate 38 with a central hole 39 that is adapted to reciprocally receive a pin 54 of a lower plunger member 50. As shown by FIG. 1, the lower plunger member 50 has a plunger head 52 of slightly smaller diameter than the barrel member cavity 33. The plunger head 52 is fixedly attached to the pin 54. A plunger spring retainer stud 56 is fixedly attached to an upper end of the plunger head 52 and may be used to facilitate retention of the lower end 22 of the coil spring 20 to the plunger head 52.

As further shown by FIG. 1 an upper plunger member 60 has a plunger head 62 with a plunger pin 64 connected to an upper end thereof and a spring retention stud 66 attached to a lower end thereof. Pin 64 is received through a hole 63 in the upper end plate 61, which may be similar or identical to bottom end plate 38. The upper plunger head 62 has approximately the same diameter as the inner diameter of the barrel cavity 33 and is fixed relative to the barrel member 32 and in continuous contact therewith. The upper plunger member 60 and barrel member 32 are held in fixed relationship as by crimping or press fitting.

When the contact pin assembly 10 is positioned between the two electrical circuits 14, 16, the coil spring 20 is placed in a compressed state. The coil spring 20 is slightly smaller in diameter than the diameter of the barrel cavity 33. There is sufficient clearance or "slop" between the barrel member tubular wall 34 and the coil spring 20, and also between the lower plunger pin 54 and the hole 39 in the lower end plate 38, to allow the plunger head 52 to be urged into a slightly skewed relationship with the tubular member cavity 33 by the compressed spring 20. The force with which the plunger head 52 is urged against the tubular wall 34 at contact point 70 is referred to in the art as the bias force or simply "bias."

Figure 3:
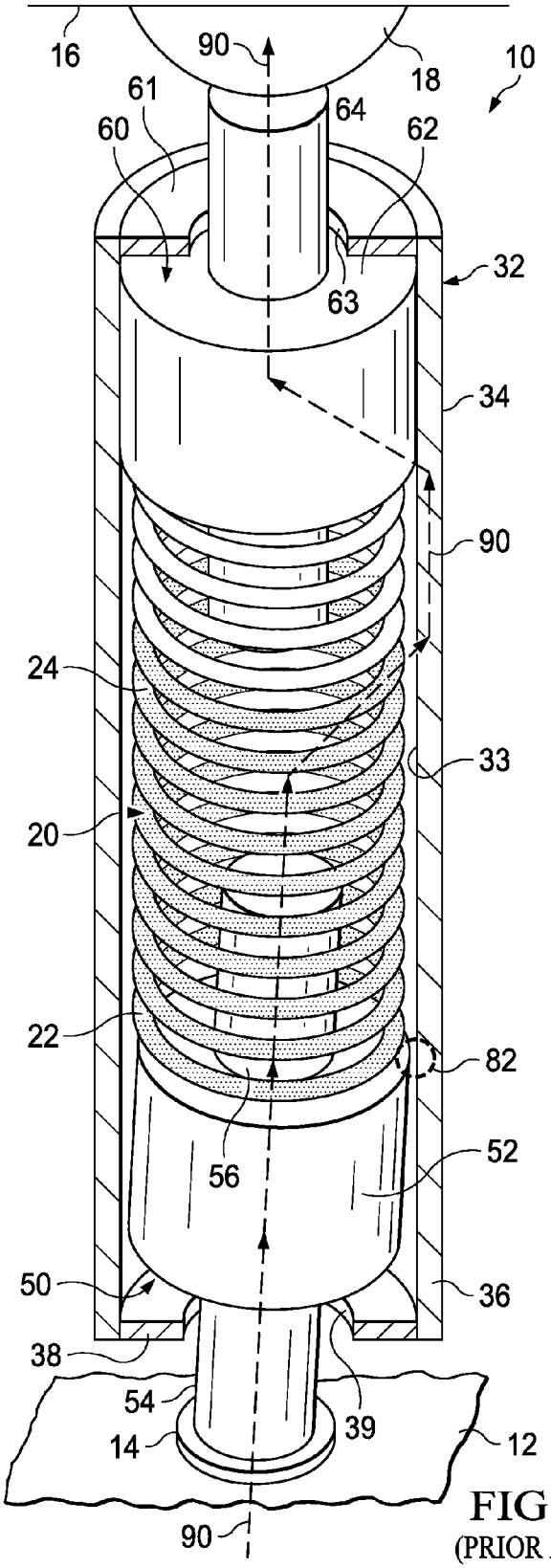
FIG. 3 (PRIOR ART)
FIG. 3 is a cut away isometric view of the prior art spring-biased contact pin assembly like that of FIG. 1 with "poor bias."

With a sufficient bias force, as shown by FIG. 1, electric current 80 flowing from the load board 12 to the DUT 16, flows through the lower plunger member 50, the barrel wall 34, the upper plunger member 60 and then to the DUT 16. However, as shown by FIG. 3, when the bias force is low, the plunger head 52 does not make firm contact with the tubular wall 34 or makes no contact at all, thus creating poor current flow or no flow of current at all from the plunger head 50 to the tubular wall 34. (In the specific embodiment shown in FIG. 3 there is a gap 82 between the plunger member 50 and the barrel wall 34 and thus no current flow.) Instead, most or all of the electrical current flows through the relatively high resistance spring 20 rather than the low resistance barrel wall 34. In the embodiment illustrated in FIG. 3 an upper portion of the spring 20 has contacted an upper portion of the tubular wall 34 providing a short length current path 90 in the upper portion, but most of the current path is through the spring 20. Flow of electricity through the high resistance spring 20 causes the spring to heat up, as indicated by speckled shading in FIG. 3.

Figure 4:
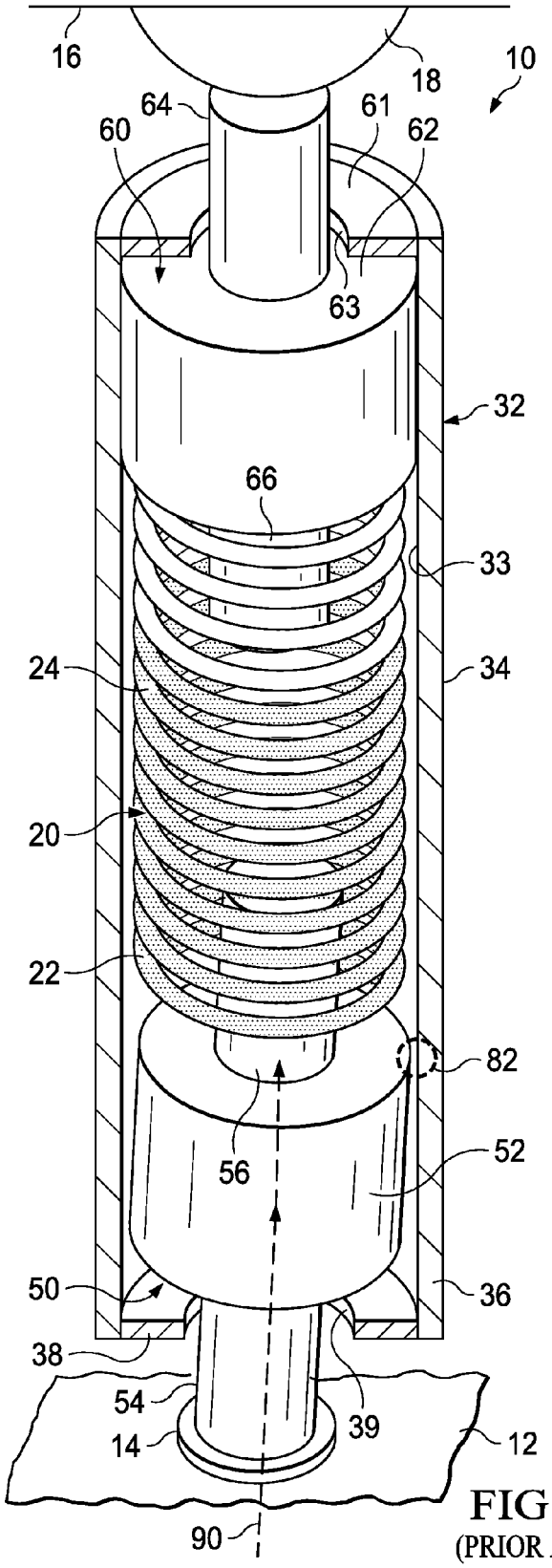
FIG. 4 (PRIOR ART)
FIG. 4 is a cut away isometric view of the prior art spring biased contact pin assembly of FIG. 3 in which the poor bias has resulted in spring disconnection.

As illustrated in FIG. 4, the heating of the spring 20 may cause it to become detached from the plunger head 52 to which it is press fit attached due to differences is the coefficient of thermal expansion (CTE) of the materials from which they are constructed. Detachment of the spring 20 creates an open circuit that completely terminates the current flow through the contact pin assembly 10, rendering it inoperative.

Figure 5:
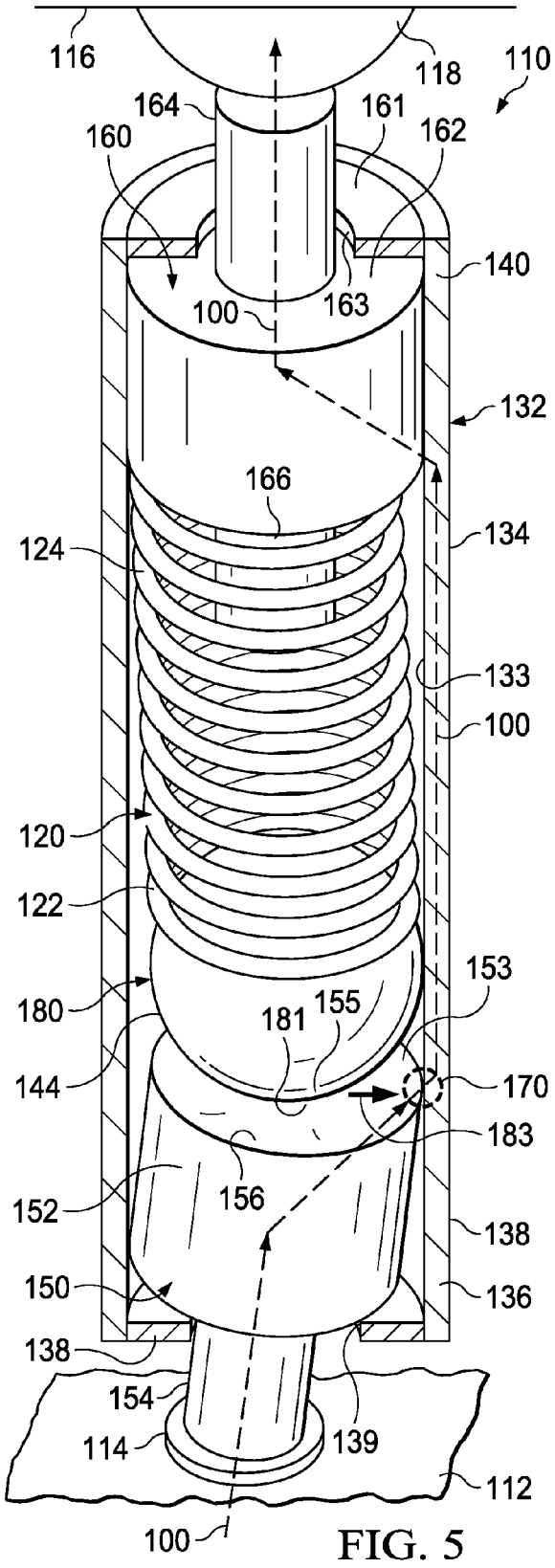
FIG. 5 is a cut away isometric view of an example embodiment of a spring-biased contact pin assembly with a high resistance spacer member.

FIG. 5 is a cut away isometric view of an example embodiment of a new spring-biased contact pin assembly 110. In FIG. 5 the electrical circuit devices that are to be connected by the contact pin assembly 110 are, again, a load board 112 with an electrical contact 114 and a device under test (DUT) 116 with an electrical contact 118. However, it will be understood that various other electrical circuit devices could be connected by the contact pin assembly 110.

The spring-biased contact pin assembly 110 includes a coil spring 120 having a lower end 122 and an upper end 124. The coil spring 120 is positioned in a barrel member 132 having a tubular wall 134 defining a cylindrical barrel cavity 133 extending between a lower end 136 and an upper end 140. The barrel member 132 has a lower end plate 138 with a central hole 139 that is adapted to reciprocally receive a pin 154 extending from a lower plunger member 150. The lower plunger member 150 has a plunger head 152 with a slightly smaller diameter than the barrel member cavity 133. The plunger head 152 is fixedly attached to the pin 154.

As further shown by FIG. 5 an upper plunger member has a plunger head 162 with a plunger pin 164 extending from an upper end thereof and a spring retaining stud 166 attached to a lower end thereof. Like plunger member 60, the plunger member 160 is in held in constant nonmoving contact with the barrel member 132 as by crimping, etc. There is sufficient clearance or "slop" between the barrel member tubular wall 134 and the coil spring 120, and also between the lower plunger pin 154 and the hole 139 in the lower end plate 138, to allow the plunger head 152 to occupy a slightly skewed relationship with the tubular member cavity 133.

A high resistance or completely nonconductive ball or sphere 180 is positioned inside the barrel member 132 between the spring 120 and the bottom plunger head 152. The bottom plunger head 152 has a top face contact surface 153, which may be a concave surface 156 in which the lowest point 155 thereof is laterally offset from the central longitudinal axis of the plunger head 152.

The high resistance ball 180 engages this plunger top face contact surface 153. A lower surface portion 181 of the ball 180 that contacts the low point 155 of the concave surface 153 is laterally offset from the longitudinal centerline of the plunger head 152. The ball 180 applies a downwardly and laterally outwardly directed bias force 183 to the plunger head 152, urging it into firm electrical contact, with a region 170 of the barrel member tubular sidewall 134. In one example embodiment the spring force urging the high resistance ball 180 against the top face contact surface 153 may be about 0.245N. An electrical current path 100 thus extends through the lower plunger member 150, the barrel wall 134 and the upper plunger member 160 that electrically connects the two circuit devices 112 and 116.

It will be appreciated that because the ball 180 is made from an electrically nonconductive or high resistance material such as ceramic there is little if any electrical current flow through the ball 180. Since there is virtually no current flow through the ball 180, there is also virtually no current flow through the coil spring 120. Thus, essentially all of the current flow between the bottom and top plunger members 150, 160 passes through the tubular sidewall 134 of the barrel member 132. As a result there is little or no heating of the spring 120 and thus no spring heating or damage.

As used in this disclosure, the terms "top," "bottom," "upper," "lower" and similar terms are used in a relative sense to describe the positional relationship between the various components shown in the drawings. These terms are not used in an absolute sense to describe an orientation of an object with respect to a gravitational field, Thus, a "lower plunger member" as described in this specification and drawings is properly referred to as a "lower plunger member" in a spring-biased contact pin assembly such as shown in FIG. 5, even when the contact pin assembly is positioned upside down with respect to the orientation shown in FIG. 5.

Figure 6:
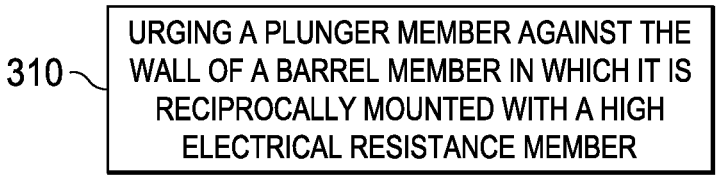
FIG. 6 is a flow diagram of a method of transmitting electricity through a spring biased contact pin assembly.

FIG. 6 is a flow diagram of a method of transmitting electricity through a spring biased contact pin assembly. The method includes, as shown at block 310, urging a plunger member against the wall of a barrel member in which it is reciprocally mounted with a high electrical resistance member.

Figure 7:
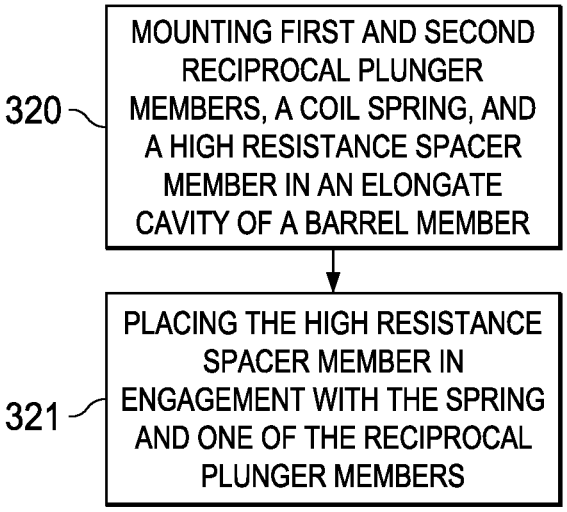
FIG. 7 is a flow diagram of a method of making a spring biased contact pin assembly.

FIG. 7 is a flow diagram of a method of making an electrical contact assembly. The method includes, as shown at block 320, mounting first and second reciprocal plunger members, a coil spring, and high resistance spacer member in an elongate cavity of a barrel member. The method further includes, as shown at block 321, placing the high resistance spacer member in engagement with the coil spring and one of the reciprocal plunger members.

Although certain embodiments of a spring biased contact pin assembly and methods of making and using a spring biased contact pin assembly have been expressly described in detail herein, other embodiments thereof will occur to those skilled in the art after reading this disclosure. It is intended that the language of the appended claims be broadly construed to cover such alternative embodiments, except as limited by the prior art.

What is claimed is:

1. A spring biased contact pin assembly comprising:

a barrel member having a barrel wall defining an internal cavity with a lower end and an upper end;

a plunger member having a plunger head and a pin attached to the plunger head, the plunger head positioned within said internal cavity proximate said lower end of said internal cavity and having a concave surface facing toward said internal cavity, said pin extending outside said internal cavity;

a spring member positioned in said internal cavity between said plunger member and said upper end of said internal cavity; and a spherical member positioned in said internal cavity in contact with said concave surface of said plunger member and said spring member.

2. The assembly of claim 1, said plunger member continuously contacts with said barrel wall while said spring member is compressed.

3. The assembly of claim 1, further comprising:

an upper plunger member reciprocally mounted in said internal cavity proximate said upper end of said internal cavity in continuous electrical contact with said barrel wall.

4. The assembly of claim 1, wherein said pin is tilted at an angle towards said barrel wall.

5. The assembly of claim 1, wherein said spherical member has a higher electrical resistance than said barrel wall.

6. The assembly of claim 1 wherein said spherical member is nonconductive.

7. The assembly of claim 1, wherein said plunger member is tilted against said barrel wall.

* * * * *